US005846890A

United States Patent [19]

Deschamps

[11] Patent Number: 5,846,890

[45] Date of Patent: Dec. 8, 1998

[54] TEMPORARY SURFACE COVERING FOR THE CIRCULATION OF VEHICLES ON SANDY OR SWAMPY SOILS

[75] Inventor: Georges-Paul Deschamps, Angouleme, France

[73] Assignee: Societe a Responsabilite Limitee Deschamps, Nersac, France

[21] Appl. No.: 716,186

[22] PCT Filed: Mar. 28, 1995

[86] PCT No.: PCT/FR95/00388

§ 371 Date: Oct. 25, 1996

§ 102(e) Date: Oct. 25, 1996

[87] PCT Pub. No.: WO95/26435

PCT Pub. Date: Oct. 5, 1995

[30] Foreign Application Priority Data

Mar. 29, 1994 [FR] France ..... 94/04061

[51] Int. Cl.[6] ..... D03D 3/00

[52] U.S. Cl. ..... 442/203; 139/384 R

[58] Field of Search ..... 442/203; 139/384 R

[56] References Cited

PUBLICATIONS

Textile Manufacturer vol. 92, No. 11, Nov. 1966 Manchester GB pp. 443–444, A.J. Bennett "Honeycomb and Other Open Work–Designs" Fig. 6.

*Primary Examiner*—James J. Bell
*Attorney, Agent, or Firm*—Young & Thompson

[57] ABSTRACT

A temporary surface covering to allow or facilitate the circulation of vehicles on sandy or swampy soils. The surface covering is formed of a woven structure formed from weft threads (N° 1 to 26) of the monofilament type disposed along a single layer and warp threads (N° 1 to 10), also disposed along a single layer. The weave of the woven structure is such that each warp thread is interlaced with the weft thread preferably and approximately along half the intersections of the rows and columns of the weave so as to obtain, for each warp thread, at least one tight single weave zone (A) followed by a loose thread zone (B). The alternation of the various zones provokes retightenings of the weft threads creating a large relief (S1, S2, C1, C2) of the fabric embodied.

8 Claims, 14 Drawing Sheets

TEMPORARY SURFACE COVERING FOR THE CIRCULATION OF VEHICLES ON SANDY OR SWAMPY SOILS

FIELD OF THE INVENTION

The present invention concerns a temporary surface covering to allow or facilitate the circulation of vehicles on sandy or swampy soils and more specially a flexible covering able to be deployed like a carpet.

BACKGROUND OF THE INVENTION

There are virtually no structures for temporarily covering this type of soil and able to be deployed to the actual surface of the soil to allow the circulation of vehicles, apart from rubber track type structures used by military engineering, these structures being structures with extremely heavy expensive steel cable reinforcements.

Now, there is a need, especially on sea shores having sandy areas, beaches, dunes, to have light inexpensive temporary covering structures able to be easily placed and removed to permit the routing of emergency of fire-fighting devices on sites only accessible by sandy tracks where there is a risk of sinkage.

In fact, the surface covering of the invention is suitable for all surface types with inadequate coherence or all unstable soils, especially sandy, swampy or muddy soils not exhibiting sufficient coherence on the movement of 2-wheel drive vehicles.

The aim of the present invention is to provide a surface covering suitable for the circulation of vehicles on a sandy or swampy soil.

SUMMARY OF THE INVENTION

To this effect, the invention concerns a temporary surface covering for the circulation of vehicles on sandy or swampy soils, wherein it is formed of a woven structure formed from monofilament type weft threads disposed along a single layer and warp threads, also disposed along a single layer, the weave of the woven structure being such that each warp thread is interlaced with the weft threads preferably and extremely approximately along half of the intersections of the rows and columns of the weave, the warp thread being left in the remaining intersections so as to obtain for each warp thread at least one tight single weave zone followed by a loose thread zone, the alternation of the various zones provoking retightenings of the weft threads creating a large relief of the embodied fabric.

This structure rolls out like a carpet, is relatively light and flexible so as to easily match the profile of the soil to be covered, allows for easy running of vehicles without the structure penetrating into the sand and allows for passage even in steep locations by virtue of the projections provided in the woven structure and which appears in the form of transverse ribs to which the vehicle tires adhere easily.

BRIEF DESCRIPTION OF THE DRAWINGS

Other characteristics and advantages shall appear more readily from a reading of the following description of embodiments of the structure of the invention, said description being given solely by way of example and with reference to the accompanying drawings on which.

DETAILED DESCRIPTION OF THE INVENTION

Figure 1:
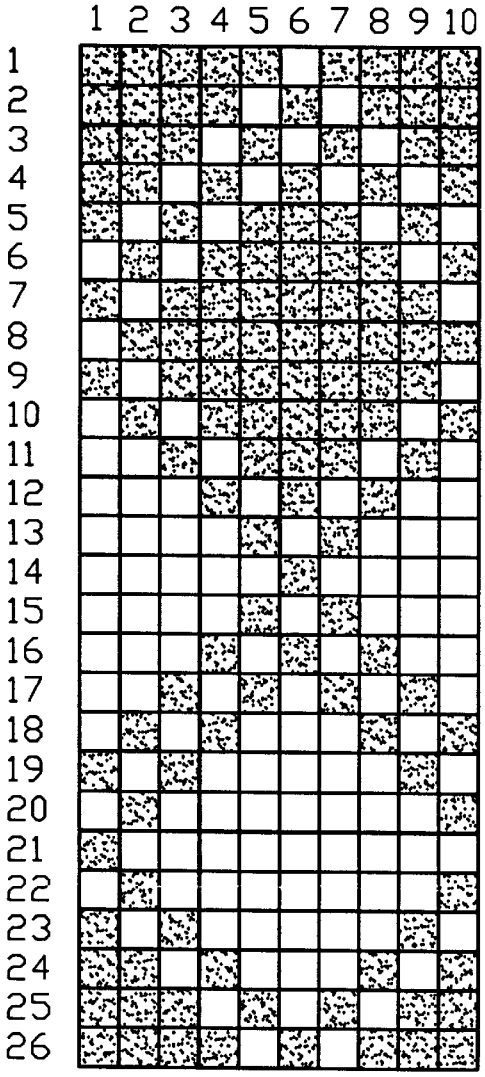
FIG. 1 represents a weave of a woven covering structure conforming to the invention.

FIG. 1 shows a preferred weave of the woven structure of the invention.

This conventionally represented weave includes ten warp threads numbered 1 to 10, corresponding to ten vertical columns and twenty-six weft threads numbered 1 to 26, corresponding to twenty-six rows.

Shown in black at the intersections of the rows and columns are the taken weft threads and in white the remaining warp threads.

Figure 2:
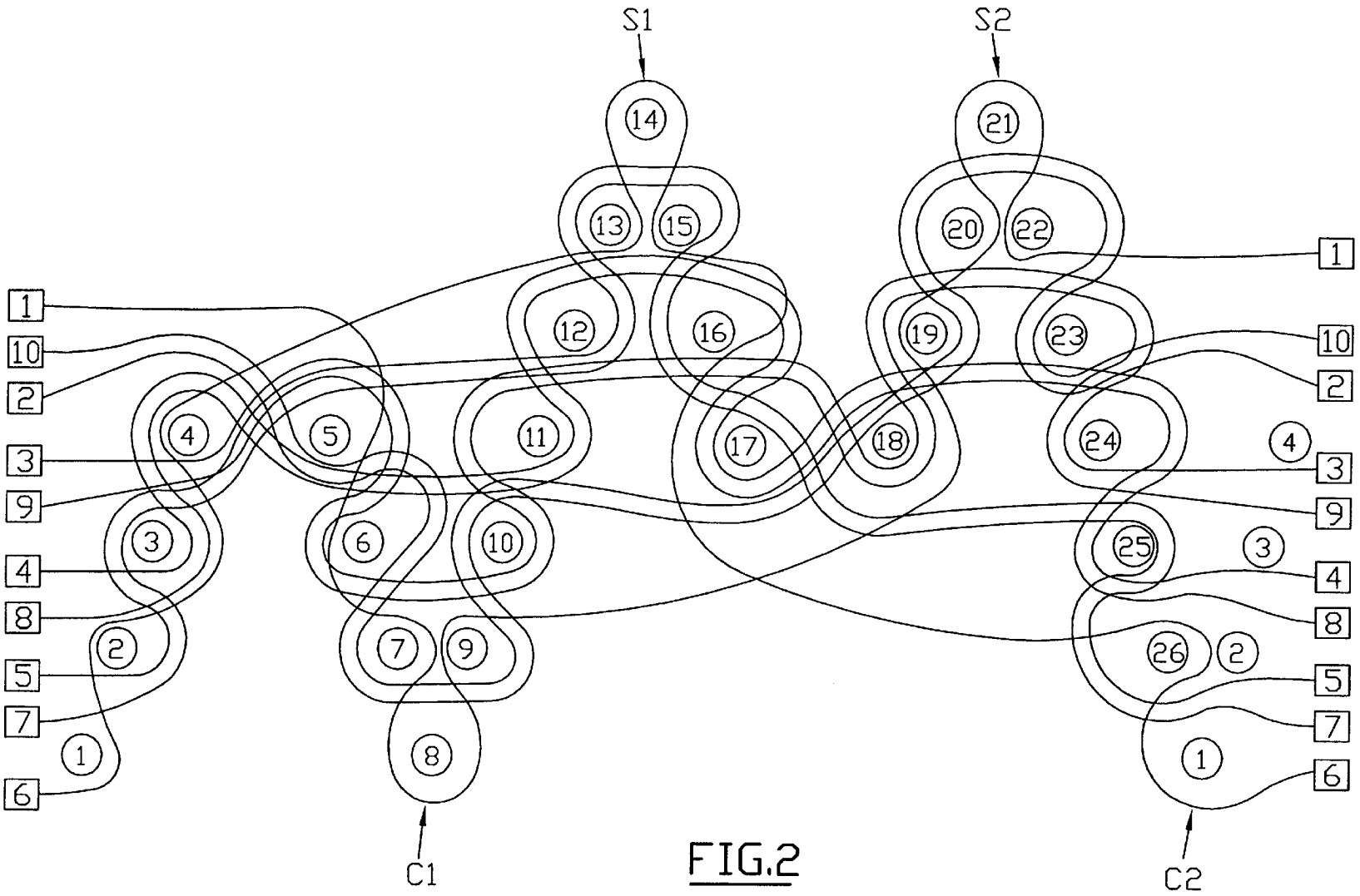
FIG. 2 is a diagram representing a woven structure along the weave of FIG. 1, the warp threads being within the plane of the figure.
Figure 3:
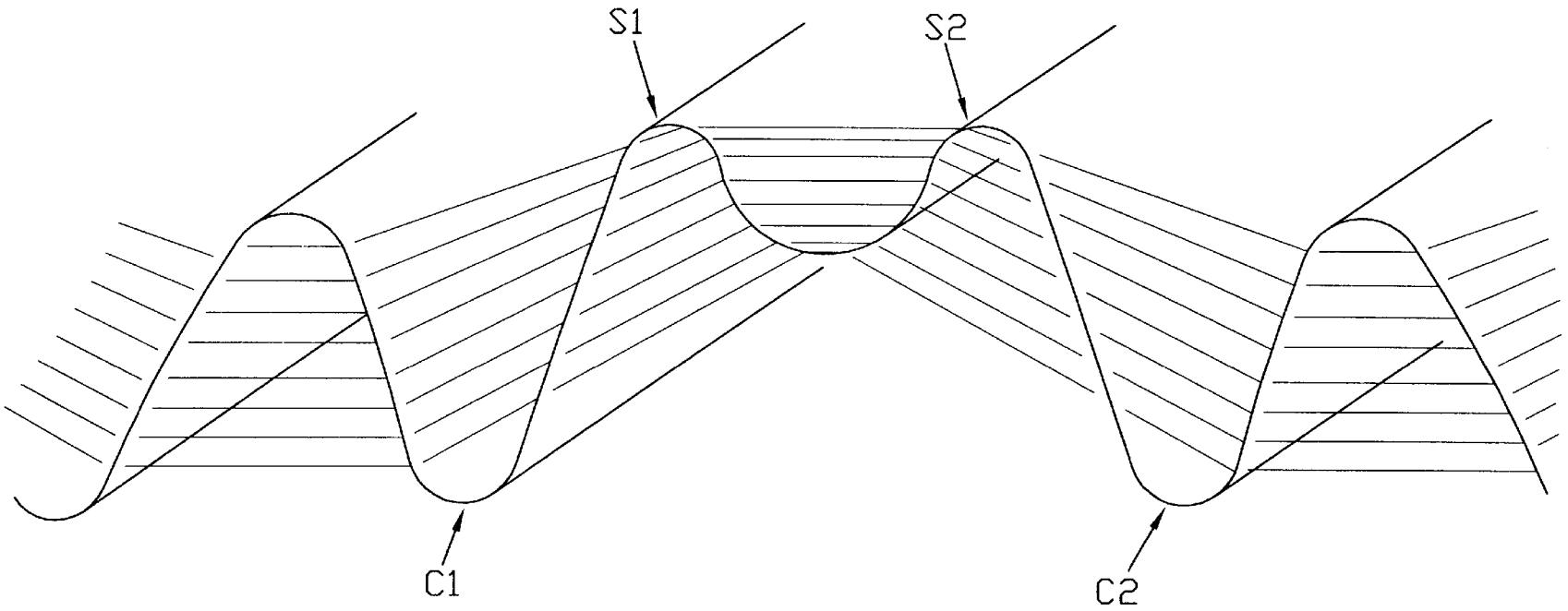
FIG. 3 is a partial diagrammatic perspective view of a woven structure in accordance with FIG. 2.

FIG. 2 represents a woven structure portion corresponding to the weave of FIG. 1, the weft threads marked 1 to 26 being seen at the end and represented by small circles, whereas the warp threads are disposed inside the plane of the figure and marked by the FIGS. 1 to 10 in small rectangles.

In accordance with the invention, the woven structure is embodied from a single warp layer covering and a single weft layer covering.

The weft threads are monofilaments so as to provide the woven structure with the required rigidity and are preferably threads with a diameter between 50 and 200 hundredths of a millimeter and made of a suitable material, such as plastic and in particular a material from the group including polyester, polyamides, polypropylenes and polyethylenes.

The warp threads may be monofilaments and possibly made of the same material as that of the weft threads and with a diameter generally smaller than that of the weft threads. The weft and warp threads normally have a diameter of 80 and 50 hundredths of a millimeter respectively.

In accordance with the invention and as illustrated by FIGS. 1 and 2, each warp thread is interlaced with the weft threads along half the intersections of the rows and columns of the weave, the warp thread being left in the remaining intersections.

Figure 4:
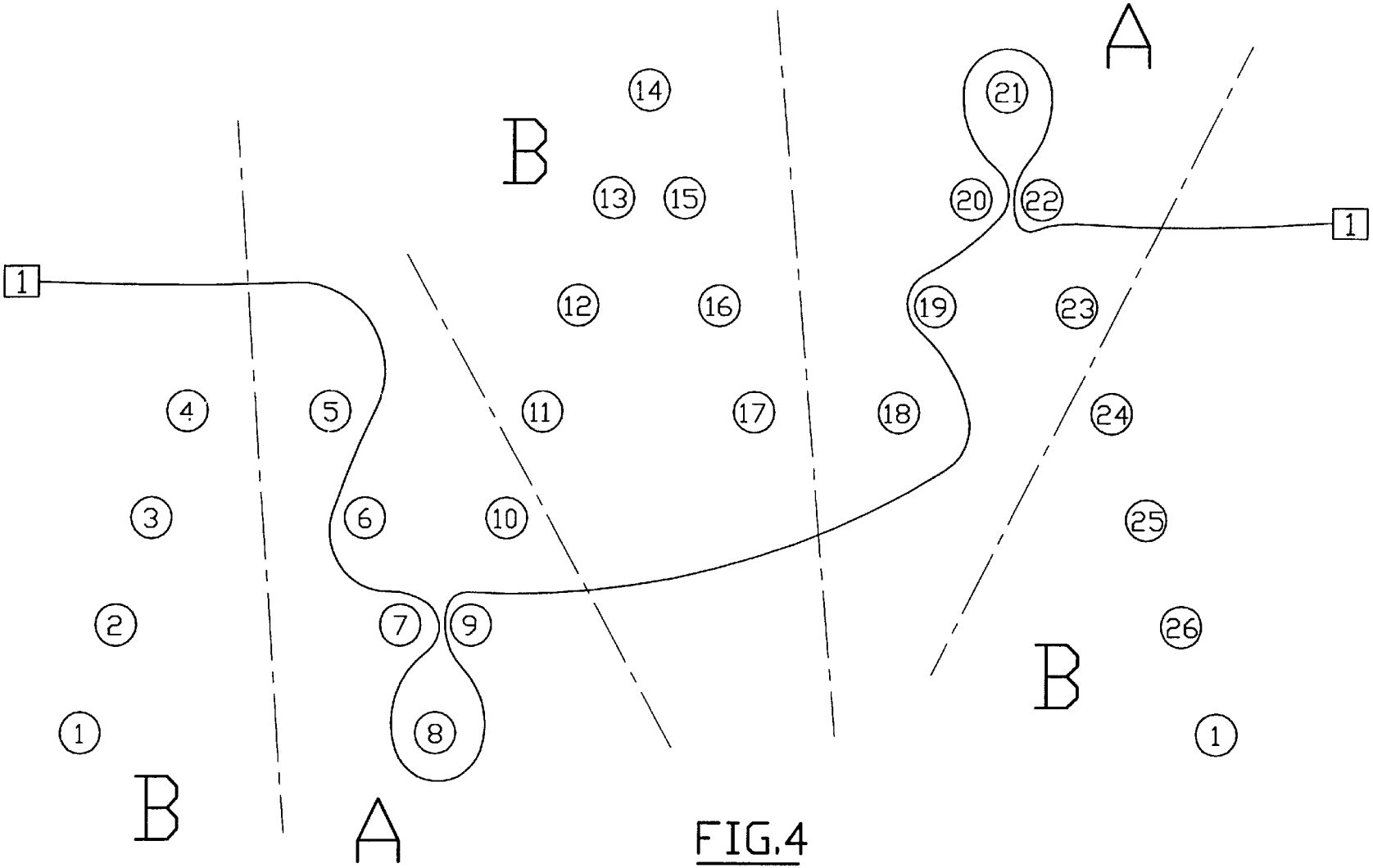
FIG. 4 represents the weave of FIG. 3 reduced to the weft threads and the warp thread N° 1.
Figure 5:
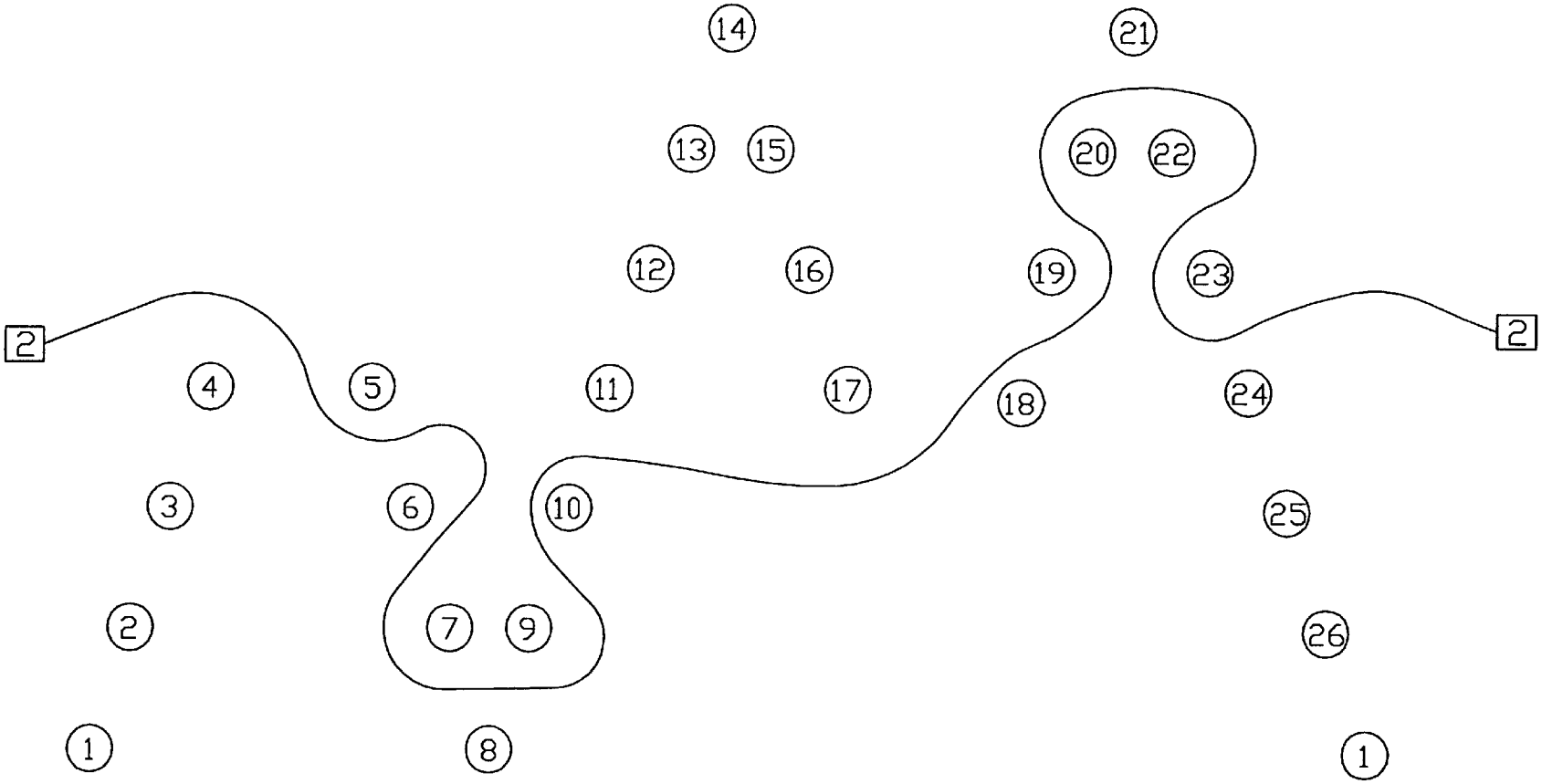
FIGS. 5 to 13 are figures similar to FIG. 4, but with the warp threads N° 2 to N° 10 respectively.

For example, with respect to FIGS. 1 and 4, it can be seen that the warp thread N° 1 moves successively (is taken) on the first five threads (N° 1 to 5), then moves (is left) under the weft thread N° 6, moves again onto the weft thread N° 7 and then under N° 8, then onto N° 9, and then moves under N° 10 to 18, then onto N° 19, under N° 20, onto N° 21, under N° 22 and finally onto N° 23 to 26.

In all, the warp thread N° 1 is taken thirteen times and left thirteen times.

For all the warp threads of the weave of FIG. 1, the same applied. This equality of takings and leavings of each warp thread results in having a given tension of the warp threads on the loom which accordingly facilitates adjustement.

Furthermore, as can be seen more clearly on FIG. 4, the warp thread N° 1 is interlaced with the weft threads (N° 1 to 26) along a fabric type tight single weave in two zones A each preceded and followed by a zone B where warp thread N° 1 is left.

Each zone A or B covers several consecutive weft threads.

FIGS. 5 to 13 illustrate the other warp threads N° 2 to 10.

It can be seen on these FIGS. 4 to 13 that, for each warp thread, there is an alternate succession of A (fabric type weave) and B (left warp threads) zones and that the number of A zones and B zones can vary from one warp thread to another.

Figure 6:
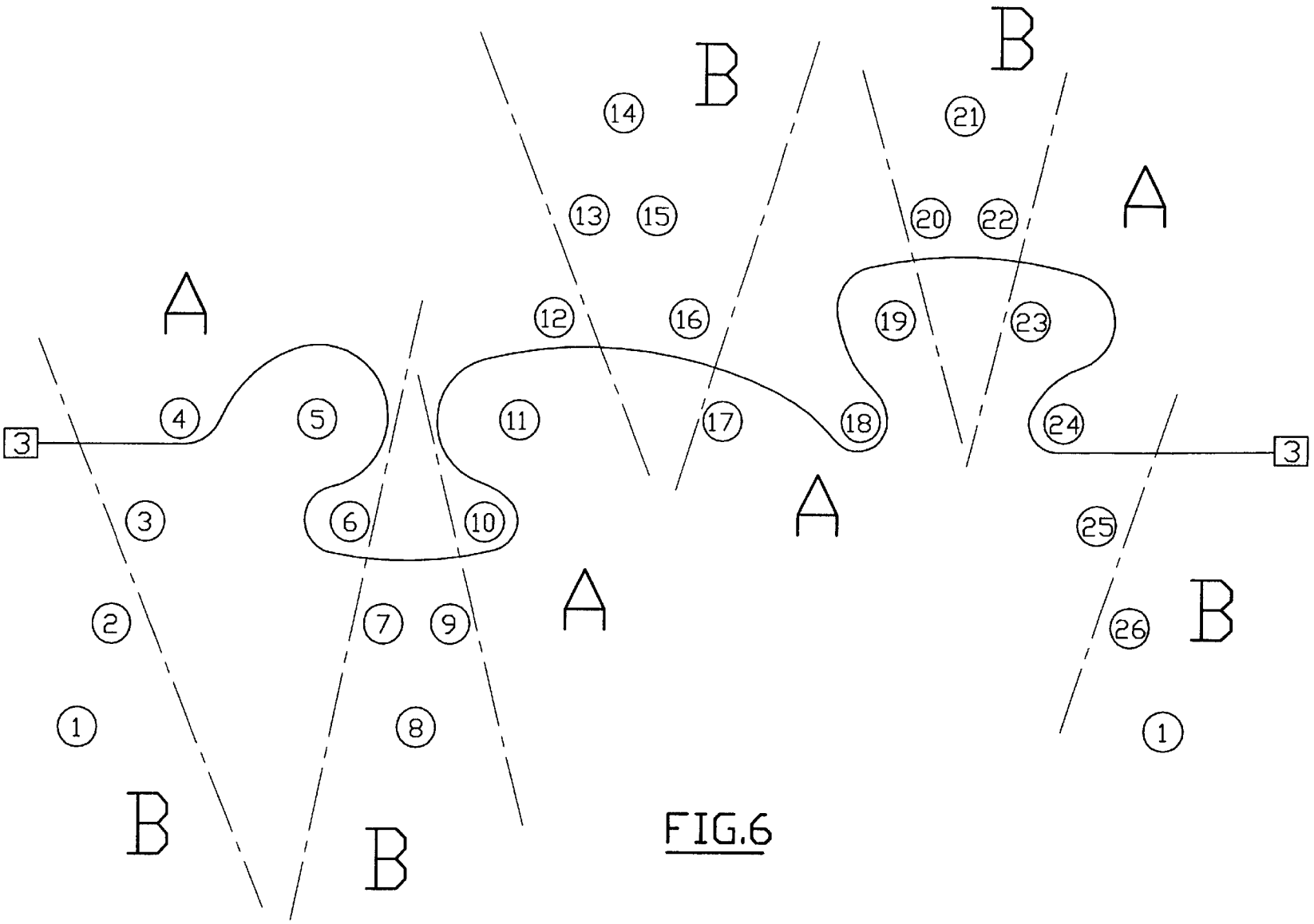
Figure 7:
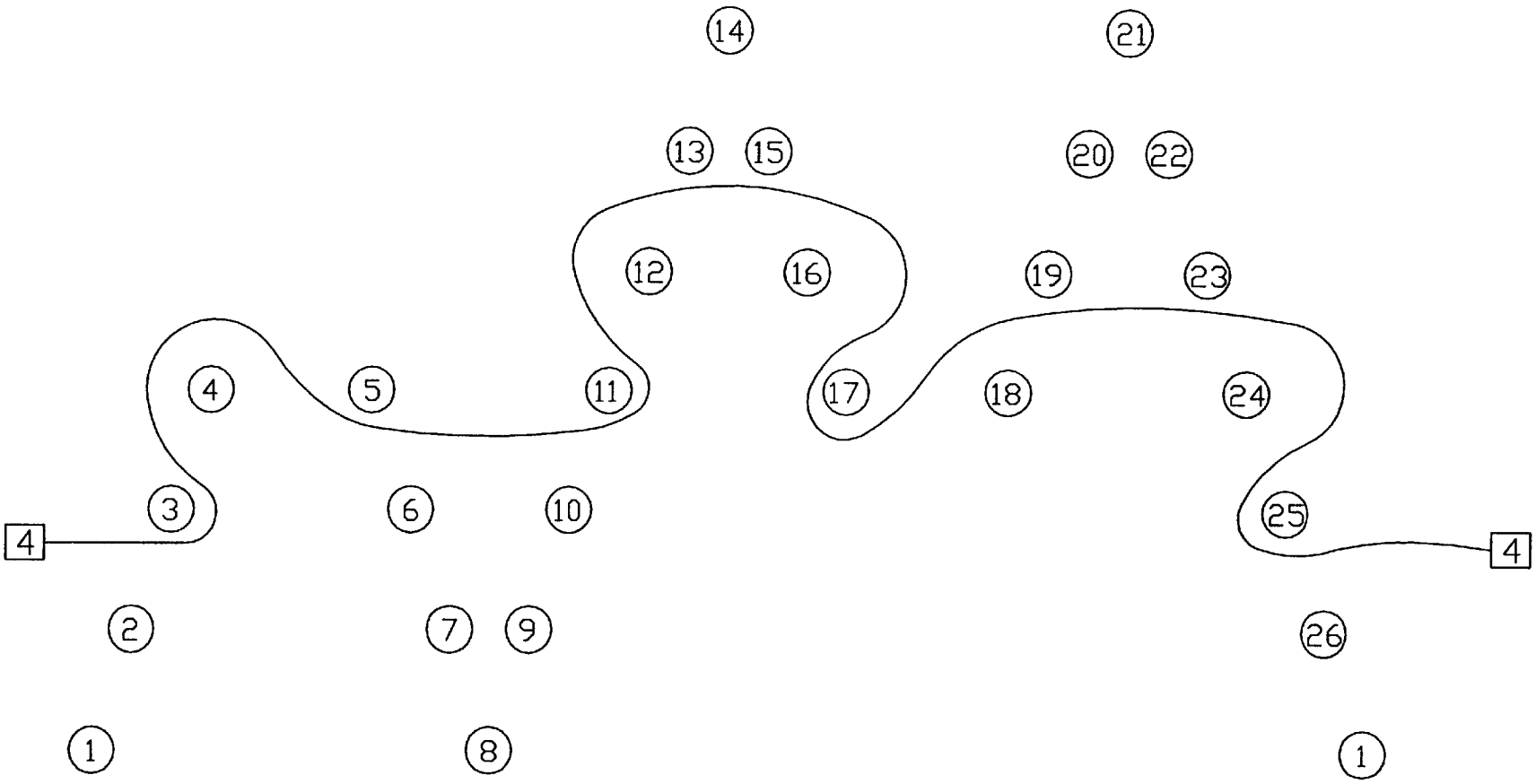
Figure 8:
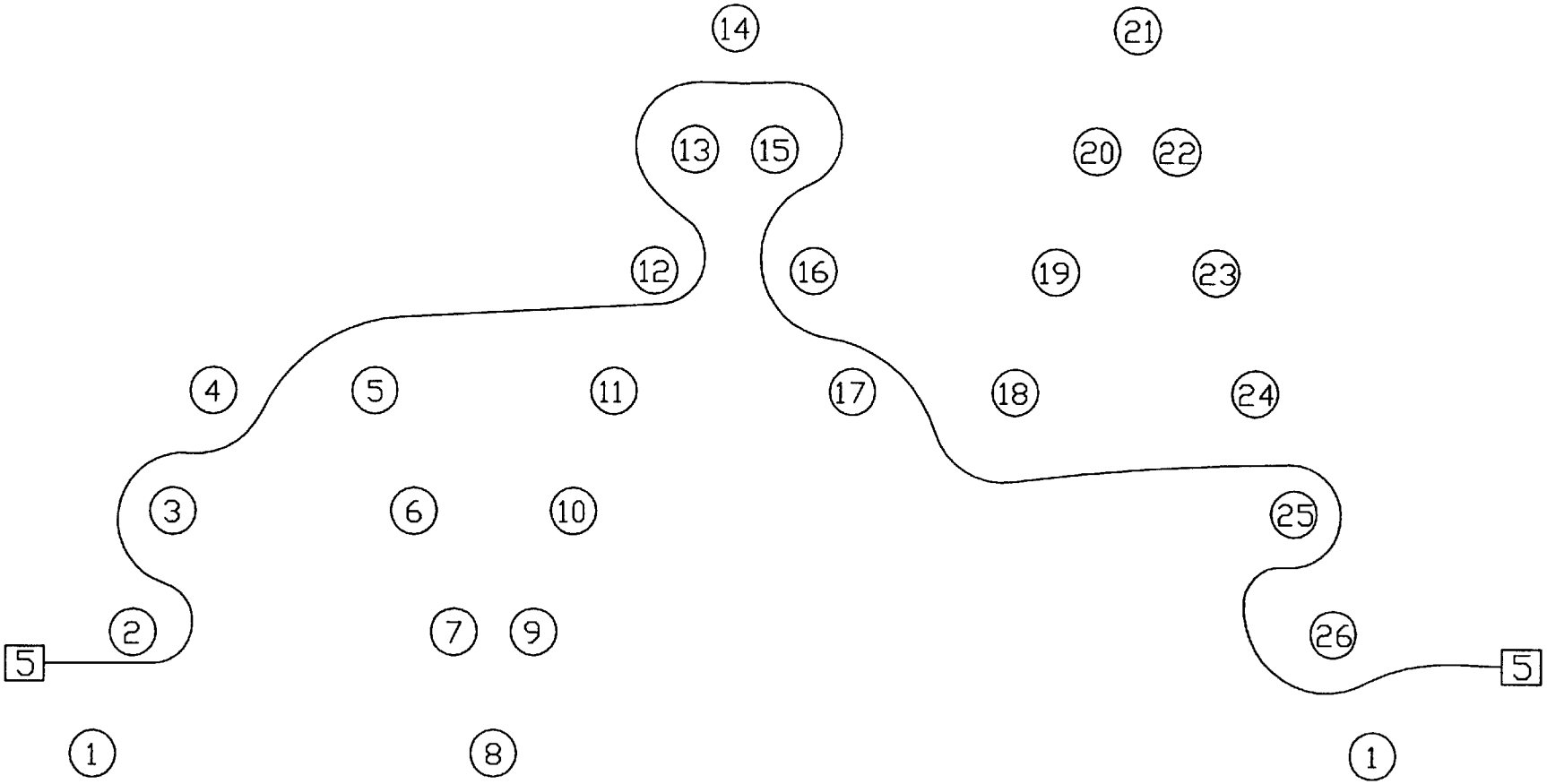
Figure 9:
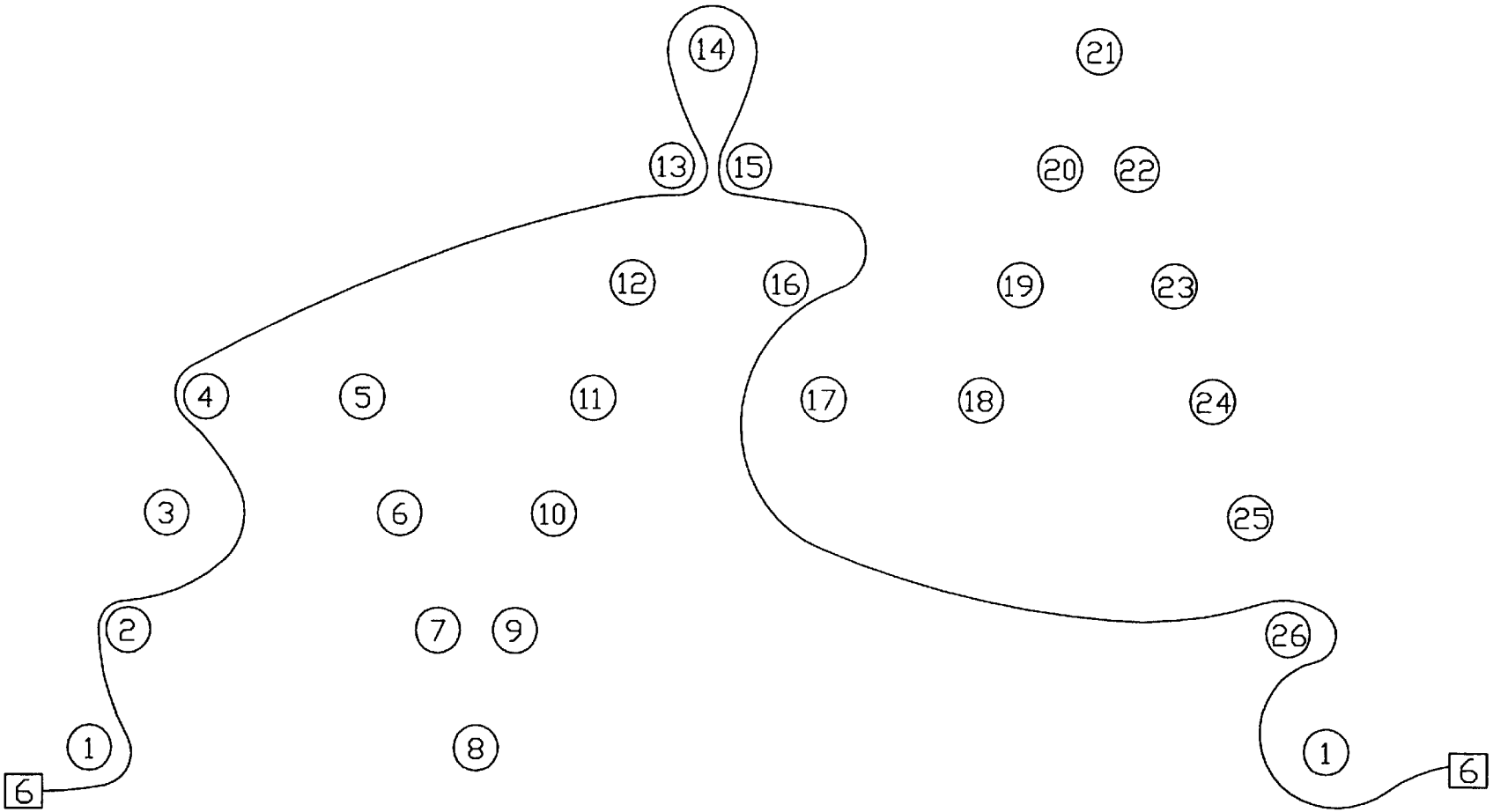
Figure 10:
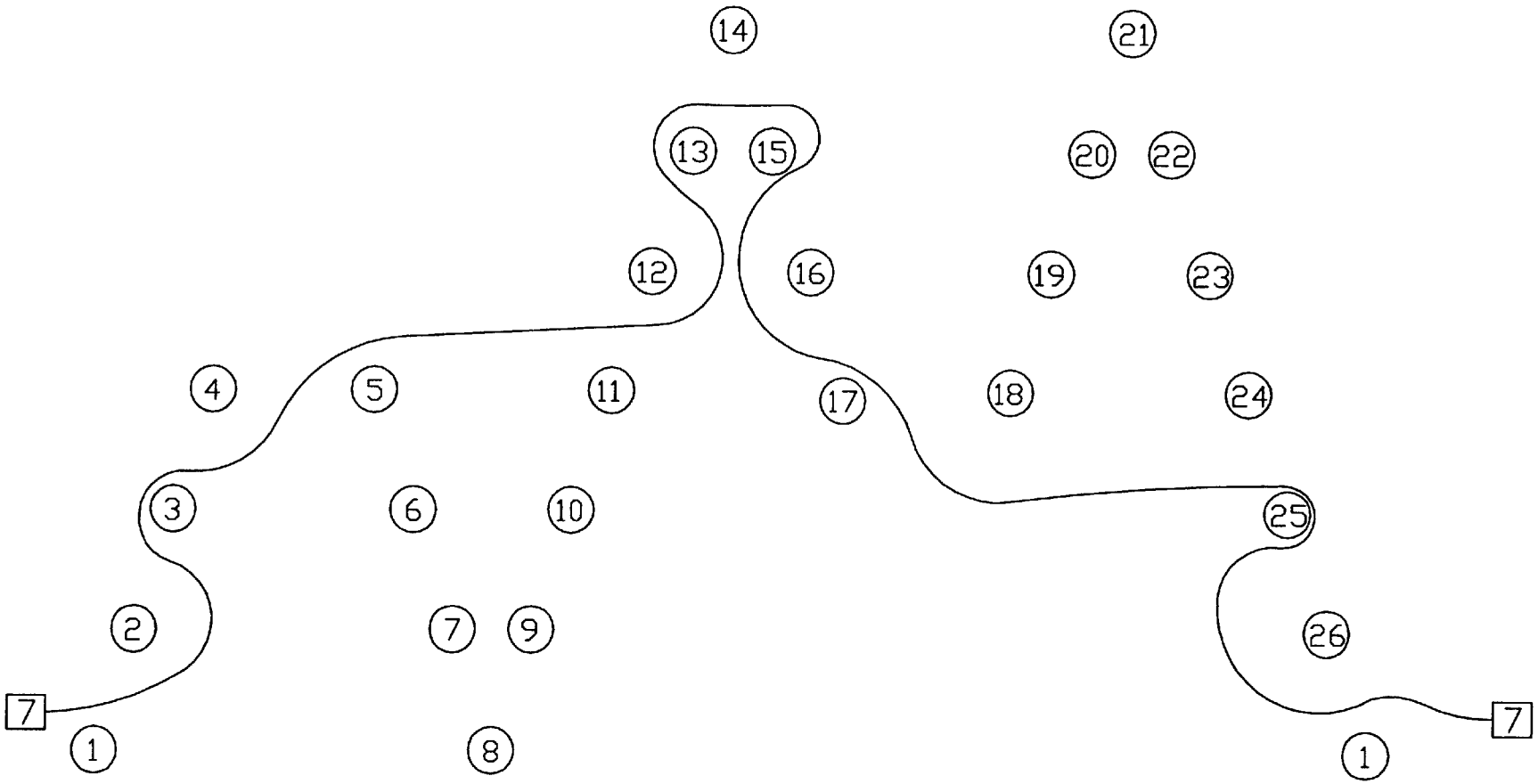
Figure 11:
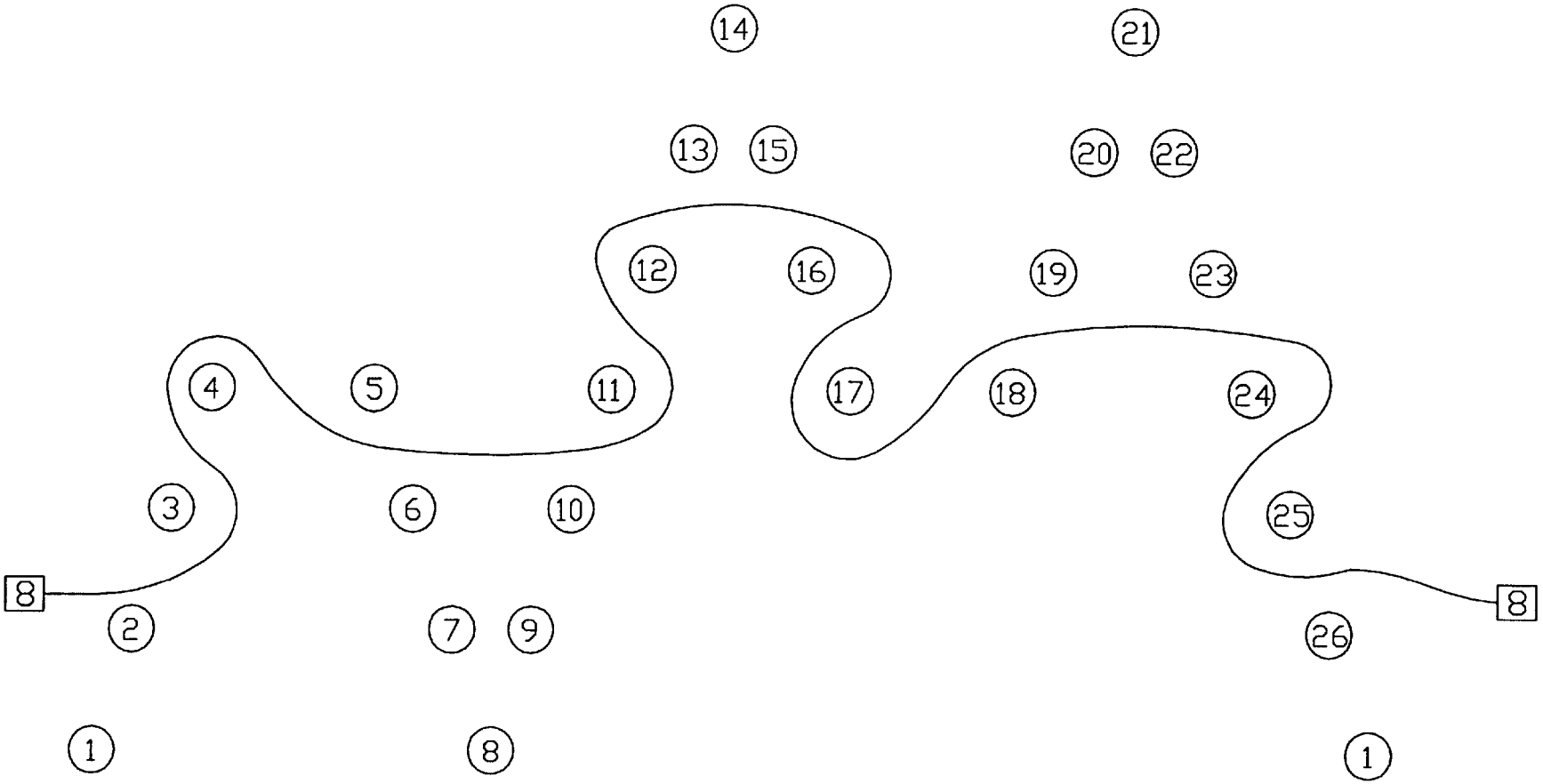
Figure 12:
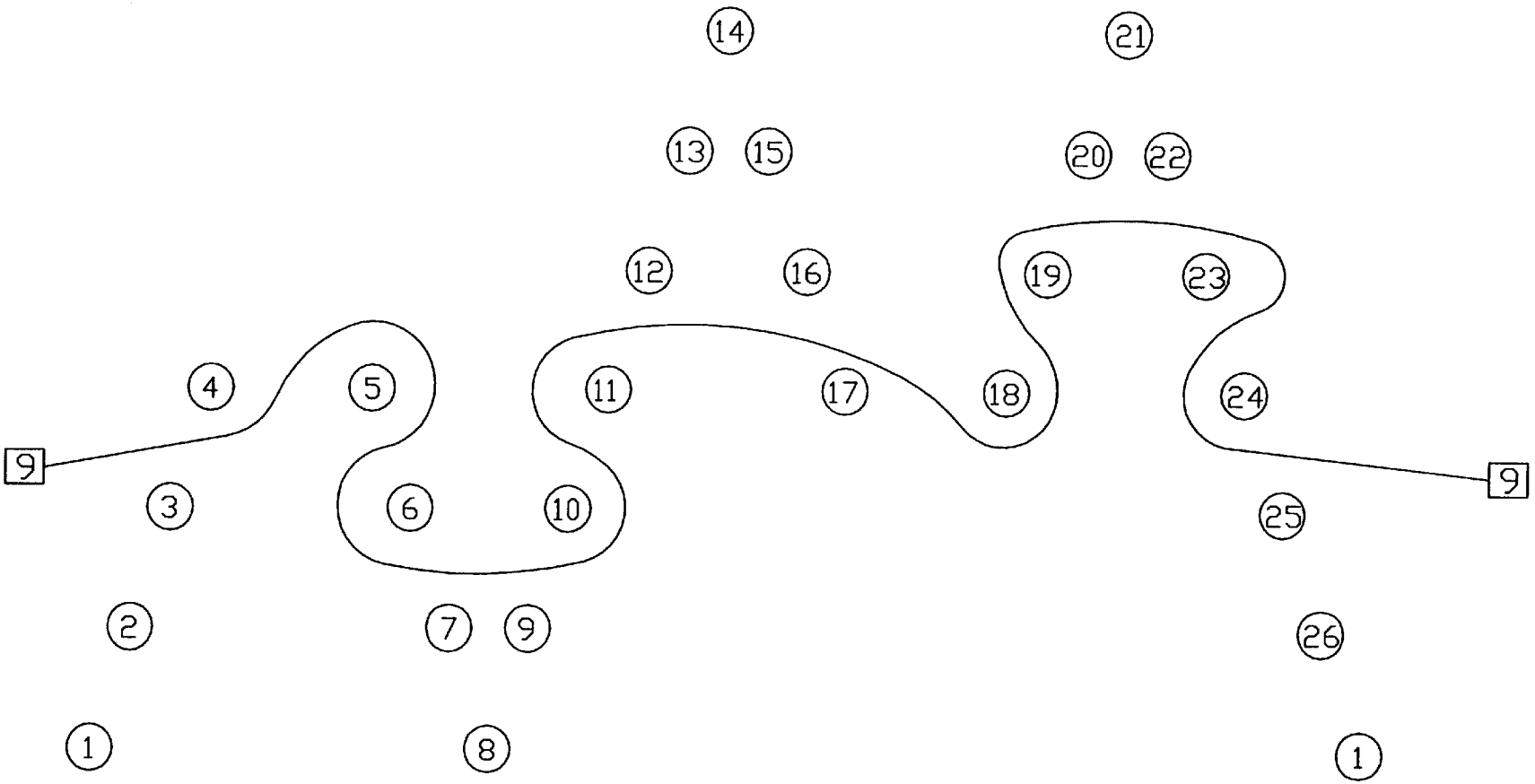
Figure 13:
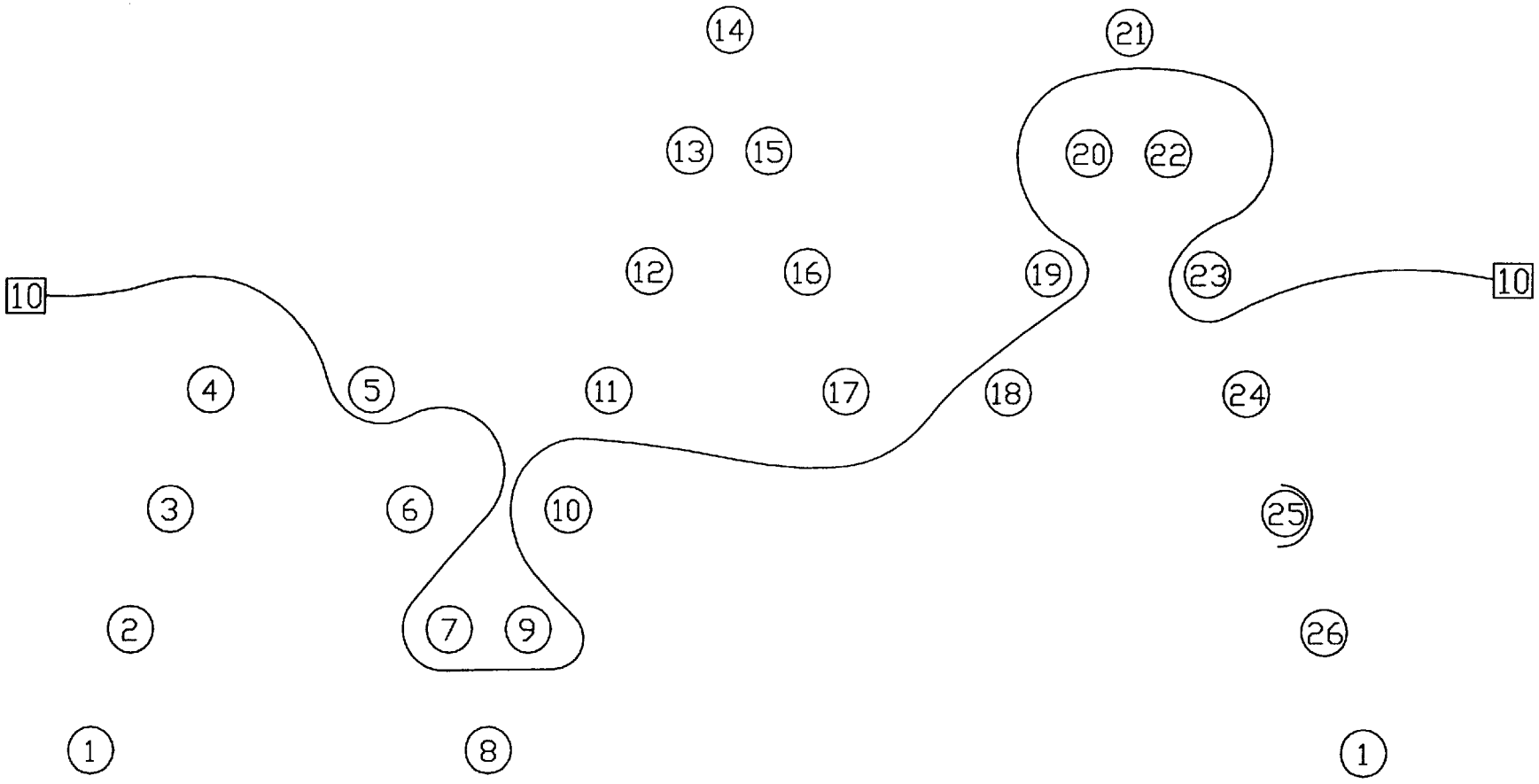

For instance, there are four A zones and four B zones (the extremity zones B only forming one) for the warp thread N° 3 (FIG. 6).

The alternation of the tight interlacing zones (A) and zones B where the warp threads are not effectively working and thus creating large loose threads provokes retightenings of the weft threads creating a large relief of the fabric. This is illustrated on FIGS. 2 and 3 which show the spatial distribution of the weft threads N° 1 to 26 approximately along a sort of undulation with projections S1, S2 and recesses C1, C2 which extend orthogonally to the warp threads and which is of course repeated over the entire length (direction of the warp threads) of the obtained fabric.

This fabric thus has on its two faces a crimped structure with ribs (S1, S2, C1, C2) transverse to the moving direction of the vehicles and which ensure a good adherence of the tires.

The woven structure rolls out and rolls up like a carpet and is thus easy to place and remove, the gsm, for 80 hundredths of a mm (weft) and 50 hundredths (warp) of polyester threads, being 725 grams per square meter, the structure having a thickness of about one centimeter.

The structure has the appearance of a grill and, although flexible and able to warp, is elastic and reassumes its shape after movement of the wheels. It does not sink into the sand. On the contrary, when removed, its carpet structure avoids any sand being retained which is thus not taken up.

The structure is of course anti-fouling and moreover leaves the soil approximately flat without any wheel rut at the location where it was deployed. Finally, it fully allows the water to pass which avoids hollowing out.

Many variants may be made to the type of weave of FIG. 1.

For instante, the warp threads may have different zones A and B concerning the number of weft threads and concerning the disposition in the weave pattern. For example, all the warp threads or a certain number can have the same A, B zones profile.

Figure 15:
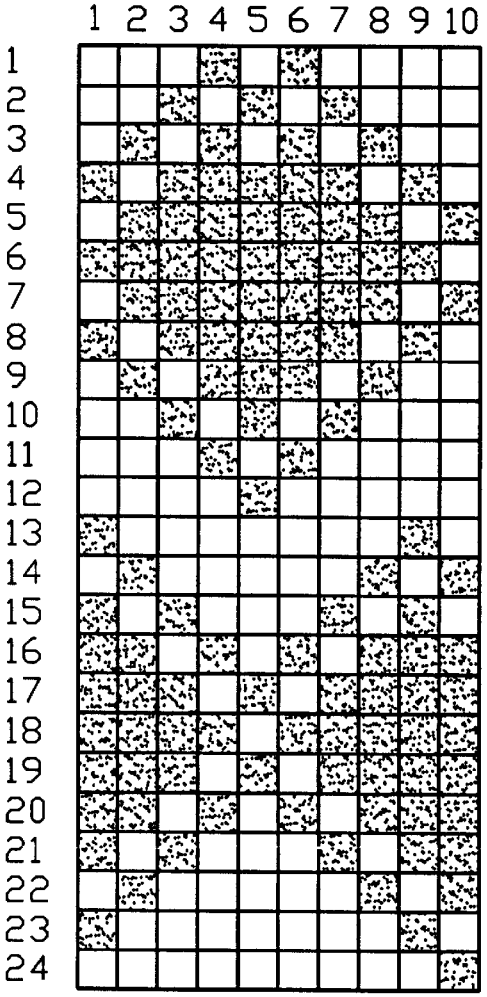
FIGS. 14 to 16 represent another weave of a structure conforming to the invention.
Figure 14:
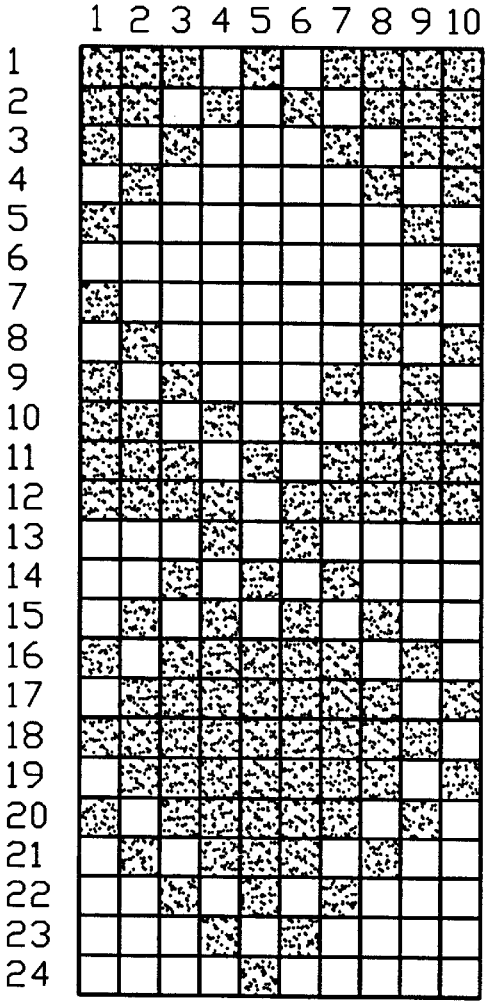

FIGS. 14 and 15 illustrate two other weaves which have a ratio (10/24) slightly different from that (10/26) of the weave of FIG. 1 and in which there is no equality of takings and leavings for each warp thread.

According to the invention, generally speaking, each warp thread of the weave preferably and approximately includes as many takings and leavings.

The expression "preferably and extremely approximately" is understood to mean that this equality of takings and leavings is not absolute and that it is possible to move away from this by 10 or 15% or even more, it being understood that the further one moves away from strict equality, the more adjustements need to be made to the loom, the woven structures obtained nevertheless forming part of the scope of the invention.

Figure 16:
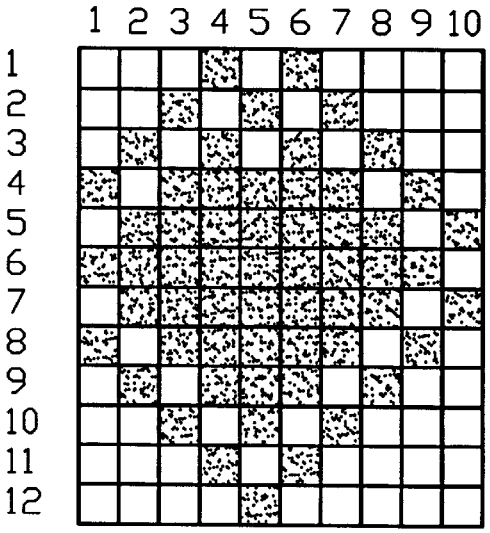

For instance, the weave of FIG. 16, which may possibly be suitable, involves for certain warp threads (N° 1, 4 to 6 and 10, for example) significant inequalities between the takings and leavings. This weave, which is almost square (10/12), nevertheless satisfies the characteristic for each warp thread of a succession of an A zone (plain weave) and a B zone (loose thread).

As stated earlier, the warp threads generally have a diameter smaller than that of the weft threads. The diameter of the warp threads is preferably only slightly smaller than that of the weft threads.

In one preferred embodiment, the covering having a weave according to FIG. 1 has a thickness of about 10 millimeters, a gsm of about 725 grams per square meter and 1000 warp threads per meter with a diameter of 50 hundreths of a millimeter and 620 weft threads per meter with a diameter of 80 hundreths of a millimeter.

I claim:

1. Temporary surface covering for the circulation of vehicles on sandy or swampy soils, comprising a woven structure formed of monofilament weft threads disposed along a single layer, and warp threads, also disposed along a single layer, the weave of the woven structure being such that each warp thread is interlaced with the weft threads approximately along half the intersections of rows and columns of the weave, the warp thread being left in the remaining intersections so as to obtain for each warp thread at least one tight single weave zone followed by a loose thread zone, the alternation of said various zones provoking retightenings of the weft threads creating a large relief of the structure with projections and recesses.

2. Covering according to claim 1, wherein the warp threads of the weave have the same type of tight single weave zone.

3. Covering according to claim 1, wherein the warp threads of the weave have the same type of loose thread zone.

4. Covering according to claim 1, wherein the warp threads of the weave have different types of tight single weave zone and loose thread zone.

5. Covering according to claim 1, wherein the tight single weave zones are plain weave.

6. Covering according to claim 1, wherein the warp threads and weft threads are made of a material selected from the group consisting of polyester, polyamides, polypropylenes and polyethylenes.

7. Covering according to claim 1, wherein the weft threads have a diameter of about between 50 and 200 hundredths of a mm, and the warp threads have a diameter slightly smaller than that of the weft threads.

8. Covering according to claim 1, and having a thickness of about 10 millimeters, a gsm of about 725 g per square meter and 1000 warp threads per meter with a diameter of 50/100 of a mm and 620 weft threads per meter with a diameter of 80/100 of a mm.

* * * * *